US009084483B2

(12) United States Patent
Patterson

(10) Patent No.: US 9,084,483 B2
(45) Date of Patent: Jul. 21, 2015

(54) MODULAR DISPLAY CASES AND DISPLAY SYSTEM

(71) Applicant: Charles Royal Patterson, Burlington, WA (US)

(72) Inventor: Charles Royal Patterson, Burlington, WA (US)

( * ) Notice: Subject to any disclaimer, the term of this patent is extended or adjusted under 35 U.S.C. 154(b) by 0 days.

(21) Appl. No.: 14/214,166

(22) Filed: Mar. 14, 2014

(65) Prior Publication Data

US 2014/0265754 A1 Sep. 18, 2014

Related U.S. Application Data

(60) Provisional application No. 61/782,192, filed on Mar. 14, 2013.

(51) Int. Cl.

| | |
|---|---|
| ***A47F 3/00*** | (2006.01) |
| ***A47B 87/00*** | (2006.01) |
| ***A63H 19/36*** | (2006.01) |
| *A47F 7/00* | (2006.01) |

(52) U.S. Cl.

CPC ..... *A47B 87/005* (2013.01); *A47F 3/005* (2013.01); *A63H 19/36* (2013.01); *A47F 2007/0092* (2013.01)

(58) Field of Classification Search

CPC ..... A47F 3/00; A47F 3/005; A47B 87/00; A47B 87/007; A47B 87/005; A63H 19/36

USPC ..... 312/114, 107, 108, 111, 118, 257.1, 312/140, 265.5, 265.6, 234, 198; 446/467

See application file for complete search history.

(56) References Cited

U.S. PATENT DOCUMENTS

| | | | | | |
|---|---|---|---|---|---|
| 1,020,557 | A * | 3/1912 | Hunter | ..... | 312/114 |
| 1,124,345 | A * | 1/1915 | Smith | ..... | 312/140 |
| 2,175,145 | A * | 10/1939 | Davison | ..... | 439/216 |
| 2,279,945 | A * | 4/1942 | Hoffman | ..... | 312/107 |
| 3,563,624 | A * | 2/1971 | Stice | ..... | 312/111 |
| 3,851,936 | A * | 12/1974 | Muller | ..... | 312/108 |
| 5,445,552 | A * | 8/1995 | Hine | ..... | 446/477 |
| 5,733,021 | A * | 3/1998 | O'Neill et al. | ..... | 312/114 |
| 5,924,778 | A * | 7/1999 | TenBrink | ..... | 312/114 |
| 7,789,470 | B2 * | 9/2010 | McCabe | ..... | 312/114 |
| 2001/0036070 | A1 * | 11/2001 | Compagnucci | ..... | 362/127 |

* cited by examiner

*Primary Examiner* — James O Hansen

(74) *Attorney, Agent, or Firm* — Seed IP Law Group PLLC

(57) ABSTRACT

A display case that includes a body having a first end and a second end and a cavity extending through the body from the first end to the second end, the cavity configured to receive at least one display item therein, such as a model train, and a pair of end caps attached to respective ends of the body and each include an attachment device to removably couple the display case to adjoining display cases. The display cases have different lengths and are attachable to any one of the other display cases. An elevator system is provided having at least one elevator device configured to move display cases. The display system is operable between an expanded state and a collapsed state. The display system has a track attached to distal ends of at least three members. The track and members are collectively collapsible between the expanded and collapsed states.

11 Claims, 16 Drawing Sheets

MODULAR DISPLAY CASES AND DISPLAY SYSTEM

RELATED APPLICATION

This patent application claims benefit under 35 U.S.C. §119(e) of U.S. Provisional Patent Application No. 61/782,192, filed on Mar. 14, 2013, which is hereby incorporated by reference in its entirety

BACKGROUND

1. Technical Field

The present disclosure relates to display cases and systems and, more particularly, to modular display cases, a display system, and an elevator system particularly adapted for displaying and moving display cases.

2. Description of the Related Art

It is often desirable to store and move collectibles for display. A variety of structures are known for this purpose. For example, shelves may be mounted on support braces connected to a wall. Bookcase type structures, i.e., floor-supported structures having multiple shelves, are also known. So that the items placed on the supporting structure are visible, these structures typically either have an open side or a glass front.

These displays have significant drawbacks. First and foremost, the displays are typically of a fixed size. The user may be forced to purchase a display that is much larger than necessary to store the desired elements. Further, if the user then obtains additional elements which exceed the number that may be held by the display, no mechanism is provided for enlarging the display short of obtaining another entire display. Also, these displays are usually arranged for use in displaying a wide variety of items. The shelves are normally thus flat surfaced for allowing the user to place any number of items thereon.

One item that hobbyists wish to commonly store and display are model trains. Typical storage units are ineffective for use in displaying model trains. First, the train components are wheeled, and readily roll about the flat shelving of typical displays. As a result, the train elements may hit and damage one another or roll from the display onto the ground or the like. In addition, because train components are usually all about the same size, if one component is placed behind another, it will not be visible. Also, it is often desirable to display an entire "train" or assembled train components. This assembly is often longer than most displays are arranged to handle. Finally, it is often desirable to move an entire train or individual train cars for display at different portions of a train display.

BRIEF SUMMARY

A display case may be summarized as including a body having a first end and a second end, and a cavity extending through the body from the first end to the second end. The cavity is configured to receive at least one display item therein, such as a model train. A first end cap is attached to the first end and includes an attachment device removably attachable to an attachment device of an adjoining display case. A second end cap is attached to the second end and includes an attachment device removably attachable to an attachment device of an adjoining display case. The end caps may be configured to provide electrical continuity between metal tracks in each of the display cases and to adjoining display cases.

A display system includes a plurality of display cases. The display cases have different lengths and are attachable to any one of the other display cases. The display system may have an elevator system having at least one elevator device configured to move the display cases.

A display system is operable between an expanded state and a collapsed state. The display system has at least three connection members extending from a central region of the system. The display system has a track attached to distal ends of the at least three connection members. The at least three connection members and the track are collectively collapsible from the expanded state to the collapsed state.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, where.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with model trains and other items, including but not limited to controllers, train cars, engines, locomotives, carriages, shuttles, rockets, turbines, jets, shuttles, slot cars, any moving light or matter, and track switching have not been shown or described in order to avoid unnecessarily obscuring descriptions of the embodiments.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

Figure 1:
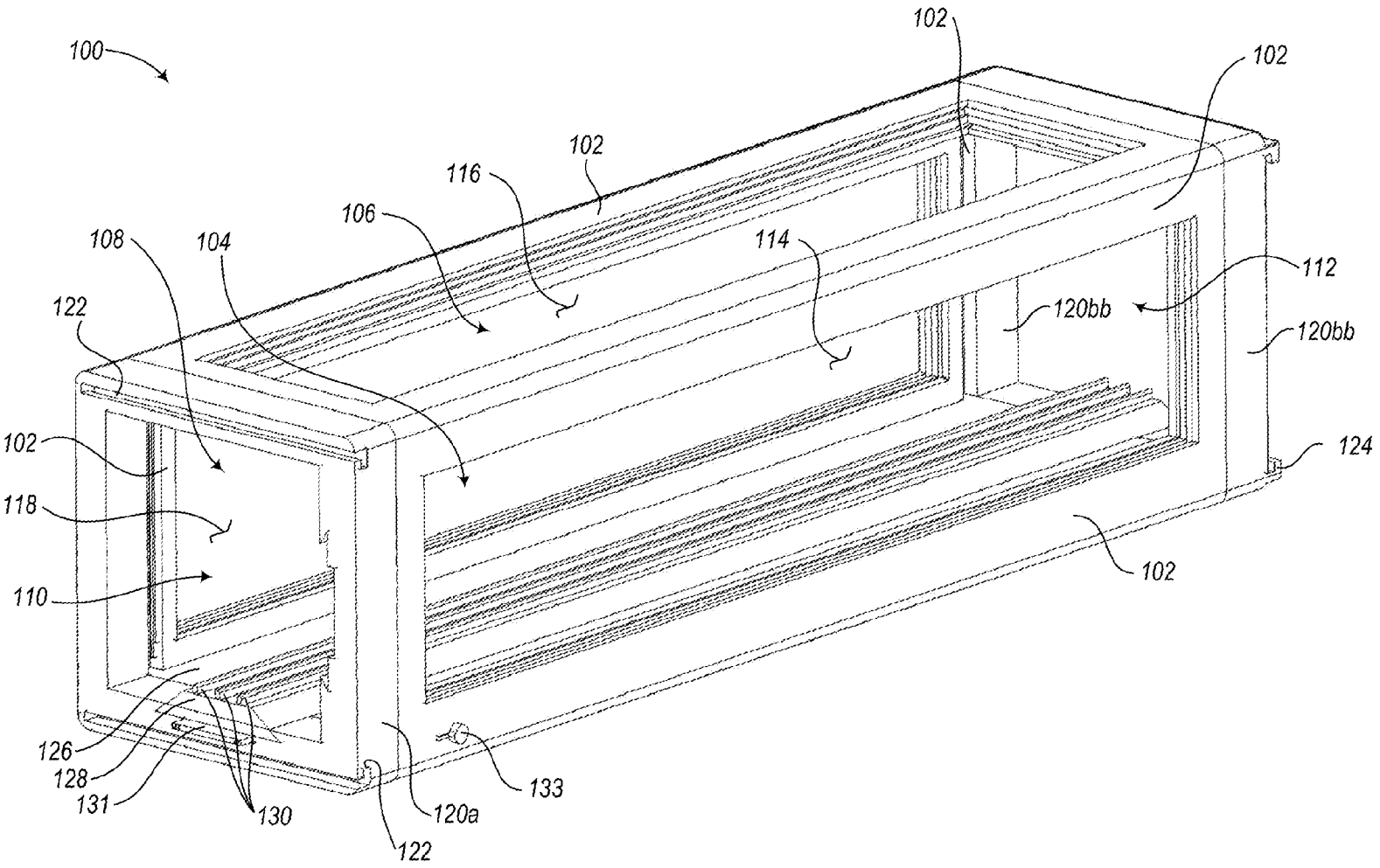
FIG. 1 is an isometric view of a display case according to an embodiment.

FIG. 1 shows a display case 100 according to an aspect of the present disclosure. The display case includes an elongated body 102 having a front opening 104, a top opening 106, a rear opening 108, a left opening 110, and a right opening 112. The left and right openings 110, 112 are positioned at opposing ends of the case and allow egress and ingress of a display item (not shown), such as one or more model train cars. A front display panel 114 covers the front opening, a top display panel 116 covers the top opening, and a rear display panel 118 covers the rear opening. All the display panels may be substantially transparent to allow viewing of a display item in the case for rear, top, front, and end view display. The rear display panel may have a scenic image on a visible portion that is viewable through the front display panel 114.

Figure 5:
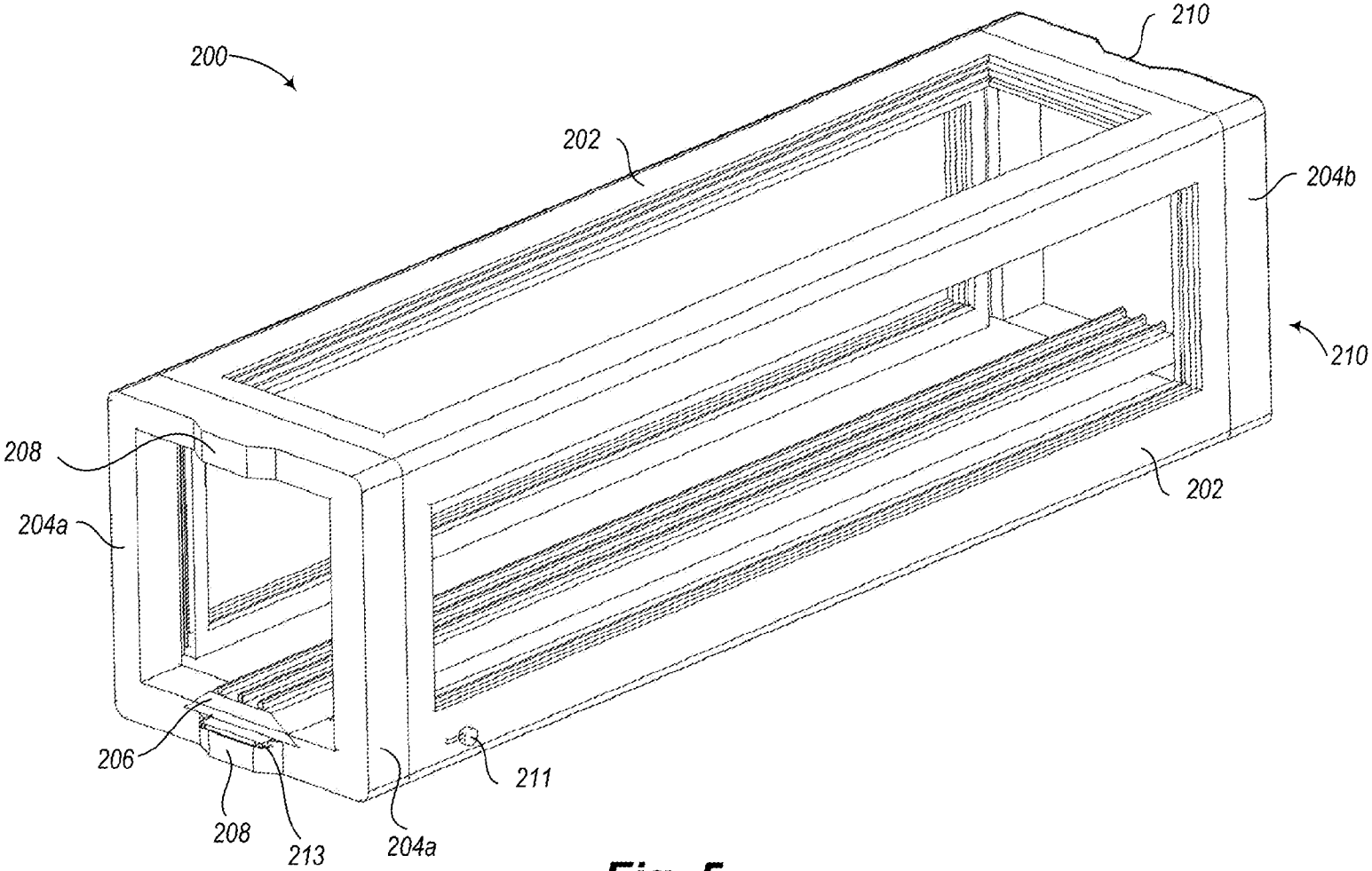
FIG. 5 is an isometric view of a display case according to an embodiment.

The display case 100 further includes a left cap 120*a* and a right cap 120*b* removably attached at opposing ends of the case 100. The left cap 120*a* includes a pair of attachment devices 122 and the right cap 120*b* includes a pair of attachment devices 124. The attachment devices 122, 124 are shown as female and male attachment devices, respectively. This enables adjacent display cases to be coupled together in a slideably interlocking fashion (see FIGS. 6 and 9). However, it is to be understood that other attachment devices could be used, such as shown in FIG. 5. The attachment devices 122, 124 are formed to receive respective attachment devices of an adjoining display case in a front loading manner such that an adjoining display case is slideably engaged to the left sides of each display case. It will be appreciated by those of skill in the art in light of the present disclosure that one attachment device may be used to attach adjoining display cases.

The display case 100 includes a base panel 126, a track member 128, and tracks 130. The base panel 126 supports the track member 128, which further supports tracks 130 (three tracks shown). The track member proximate the left cap 120*a* is positioned flush relative to the outer surface of the left cap 120*a*, which thereby positions the tracks 130 in an abutting relationship against tracks of an adjoining display case. The direct attachment between the adjoining tracks is preferably an electrical coupling so that electricity may be delivered to the train, for example, for lighting or movement if the displayed train component is an engine, locomotive, or other powered vehicle, or other items as further discussed above. The same configuration exists on the opposing side of the display case so that a plurality of display cases and respective tracks may be joined together to provide a continuous track over which a train may travel. Those of skill in the art will understand in light of the present disclosure that various alternative track mating configurations may be used or combined with the tracks shown in FIGS. 1-10.

In some aspects, an electrical connector 131 is positioned through a lower portion of the left cap 120*a*. The electrical connector 131 is coupled to a switch 133 that is operable to move the electrical connector 131 between an engaged state and a disengaged state to electrically couple tracks 130 with tracks of adjoining display cases at areas below the tracks. This eliminates the need to have small connection devices directly connecting the tracks, as with typical track connection systems. Alternatively, the switch 133 can be used to assist in guiding the attachment of an additional display case to the left end of the display case 100.

Figure 1A:
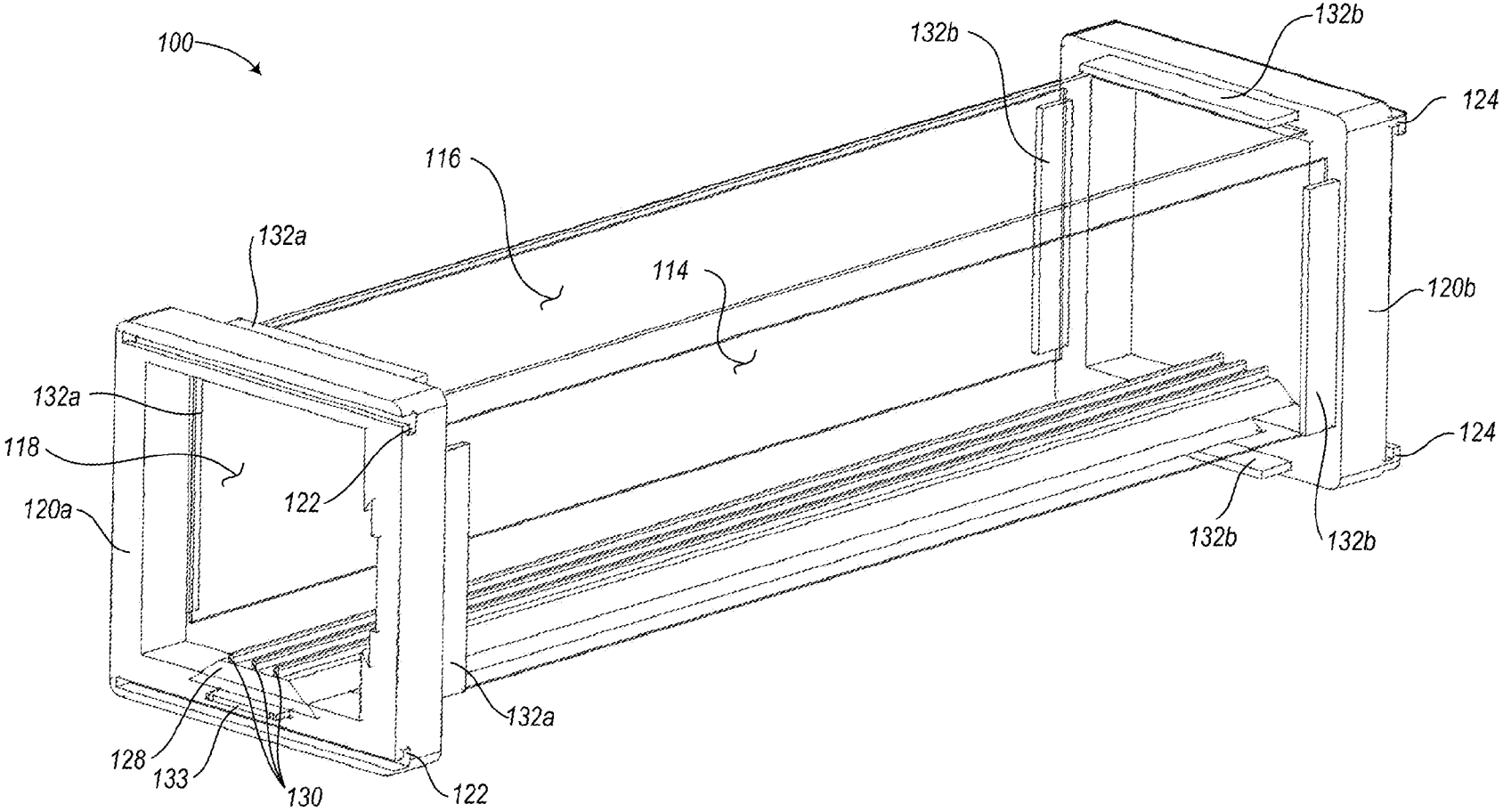
FIG. 1A is an isometric view of the display case of FIG. 1 without the body frame.

FIG. 1A shows the display case 100 of FIG. 1 with the elongated body 102 not shown in order to more clearly illustrate how the left and right caps 120*a*, 120*b* are attached to the elongated body 102. The left and right caps 120*a*, 120*b* each include four male members 132*a*, 132*b*, respectively. The male members 132*a*, 132*b* are receivable in female members (not shown) in the elongated body to provide a secure attachment.

Figure 2:
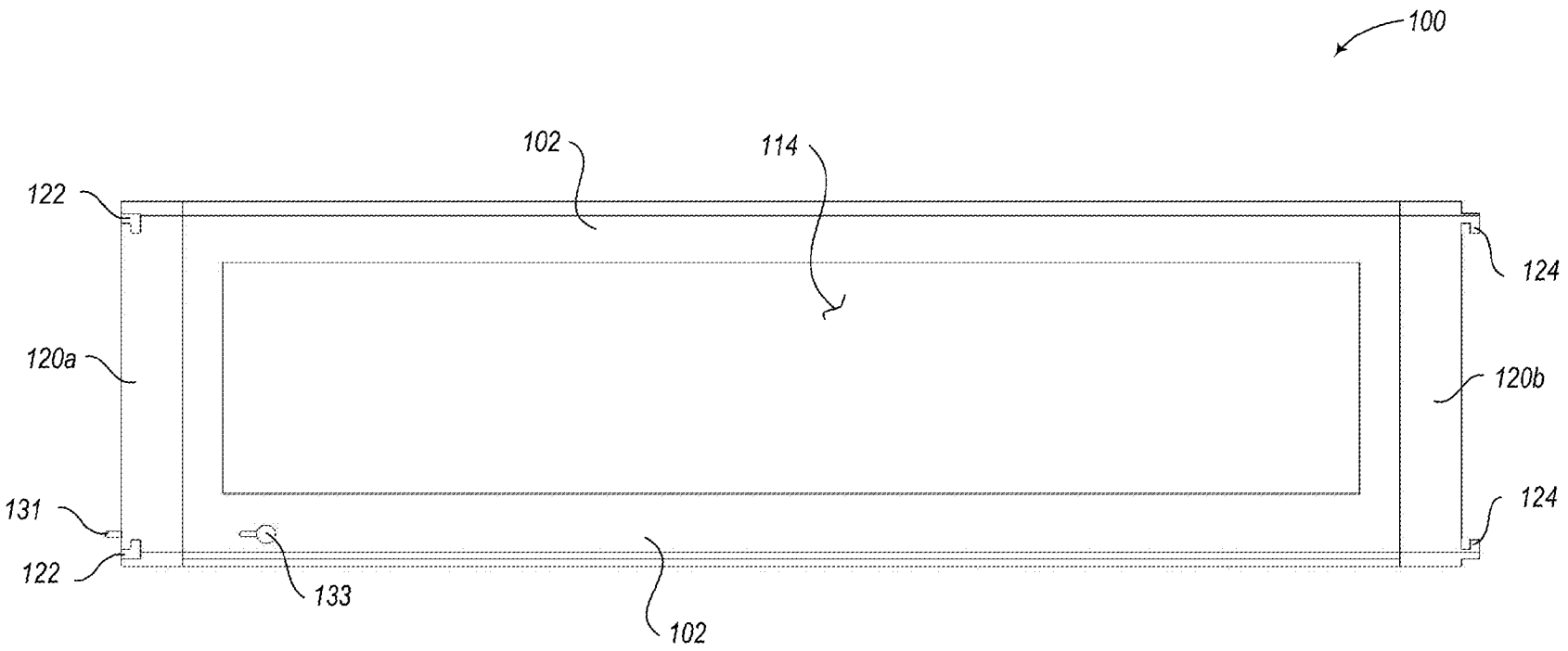
FIG. 2 is a front view of the display case of FIG. 1.
Figure 3:
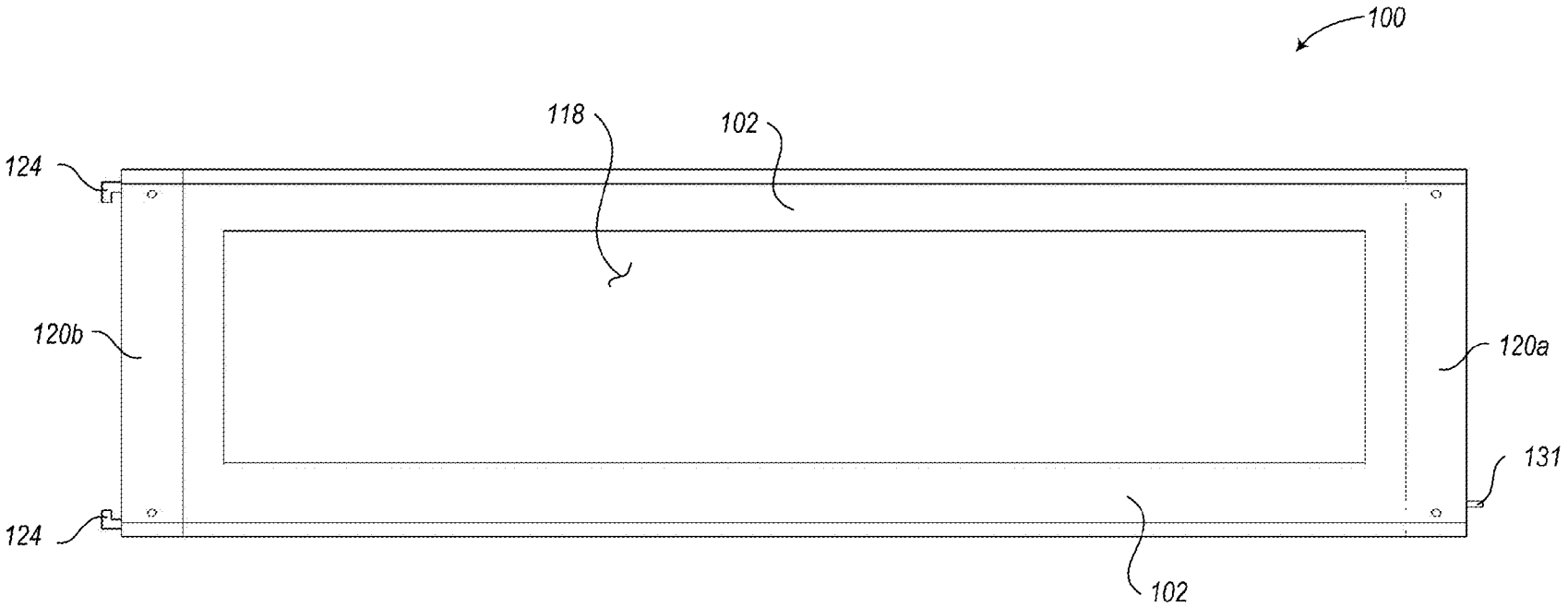
FIG. 3 is a rear view of the display case of FIG. 1.
Figure 4:
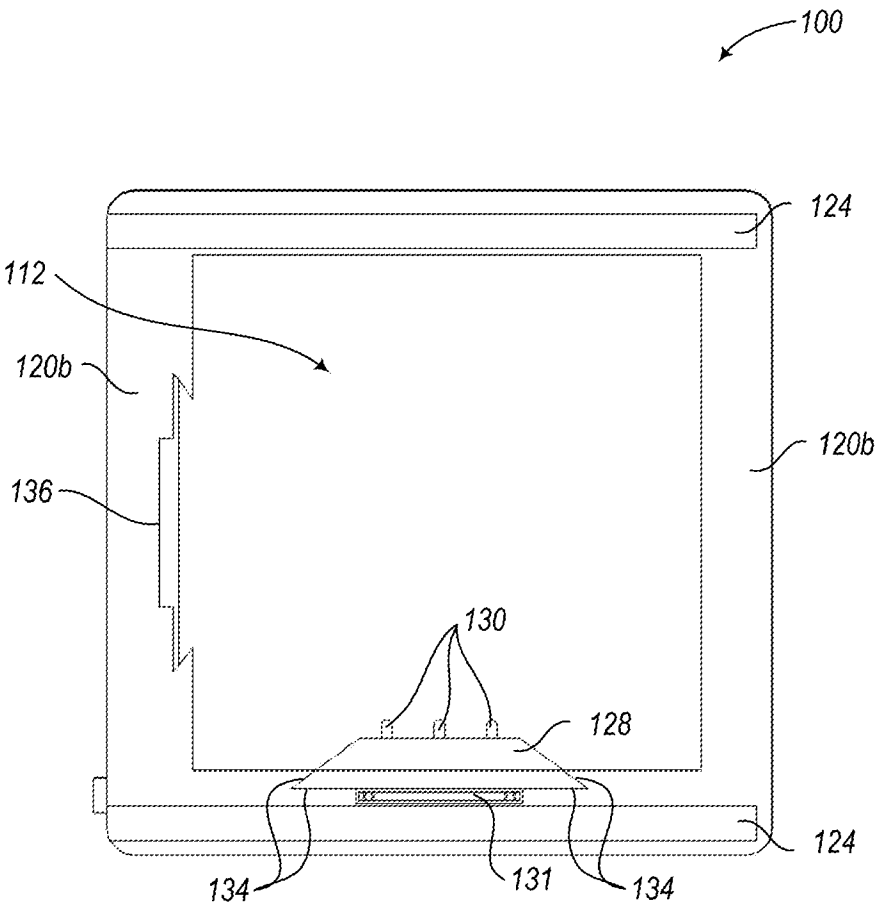
FIG. 4 is a left side view of the display case of FIG. 1.

FIG. 2 shows a front view of the display case 100 and FIG. 3 shows a rear view of the display case 100. FIG. 4 shows an elevational view of the display case 100 from the right side of FIG. 1. In particular, FIG. 4 shows the right cap 120*b* having a slot 134 sized to receive a portion of the track member 128. The slot 134 is trapezoid shaped and the track member 128 has a corresponding trapezoid shape to be received in the slot 134. A supplemental trapezoid shaped slot 136 extends through the right cap 120*b* and may receive the track member 128. Accordingly, the display case 100 may be rotated 90 degrees to the left and installed vertically on a surface, such as a ceiling. As such, the supplemental slot 136 will be the new track surface coupleable to adjoining display cases on the ceiling, for example.

FIG. 5 shows a display case 200 according to another aspect of the present disclosure. The case 200 may include some of the same features discussed with reference to FIGS. 1-4. The case 200 includes an elongated body 202 and left and right caps 204*a*, 204*b* attached to opposing ends of the body 202. A track member 206 extends through the body 202 and is coupled to left and right caps 204*a*, 204*b*. One key difference between this design and the design illustrated in FIGS. 1-4 is the attachment devices. The left cap 204*a* includes a pair of male members 208 at upper and lower portions of the left cap 204*a*. The right cap 204*b* includes a pair of female members 210 at upper and lower portions of the right cap 204*b*. The male members protrude outwardly from a planar surface of the left cap 204*a* and the female member protrudes inwardly from a planar surface of the right cap 204*b*. Accordingly, display cases 200 may be coupled to each other from vertical directions relative to each other.

Figure 6:
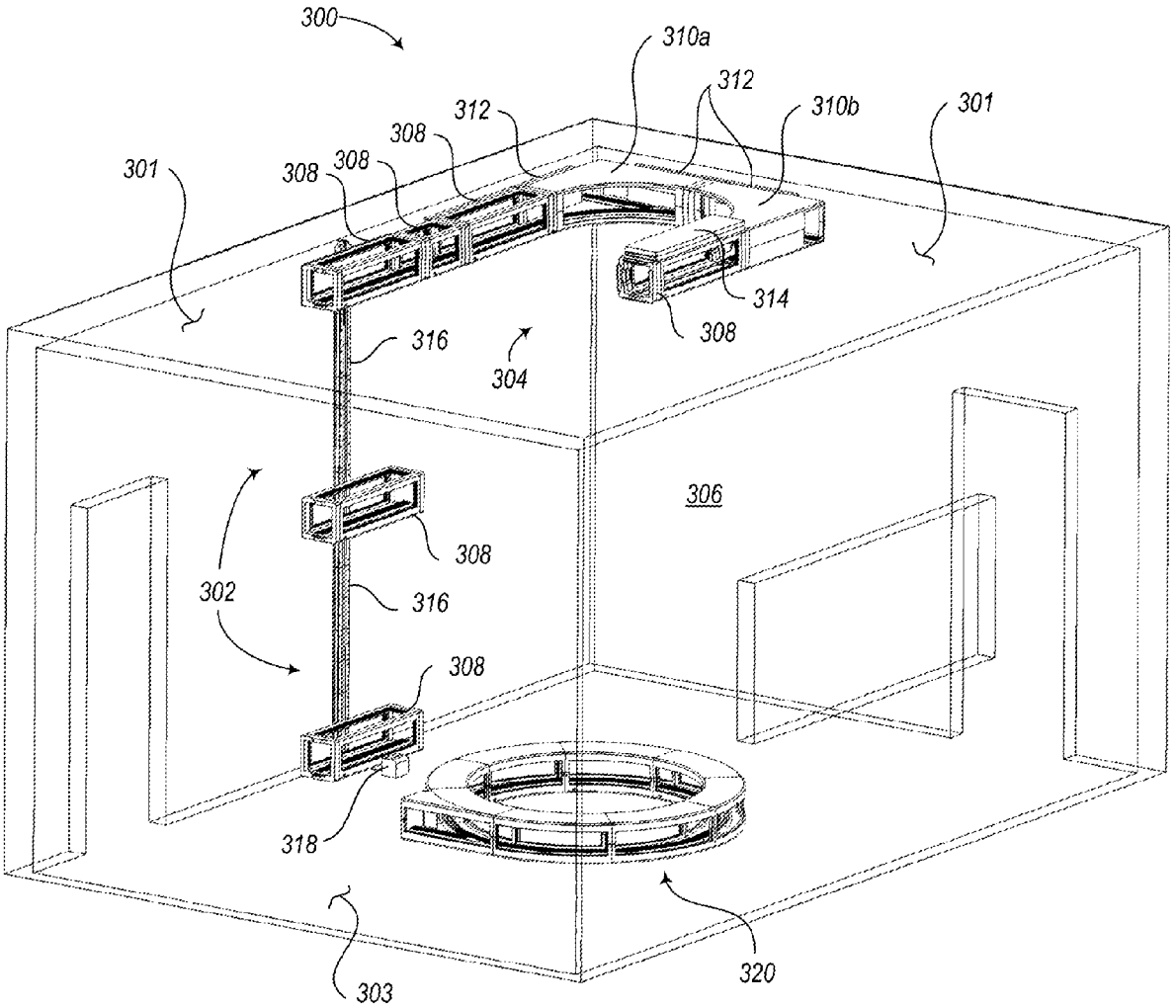
FIG. 6 is an isometric view of an elevator and display system according to an embodiment, showing the system in a room.

FIG. 6 shows a display system 300 in a room 306 according to a further aspect of the present disclosure. The system 300 includes an elevator device 302 and a plurality of display cases in the room 306. The plurality of display cases may be secured to walls 303 and a ceiling 301 and extend throughout various portions of the room 306. A display case 308 may also extend across a doorway so that that the entire system is continuous inside the room.

The display system 300 includes corner display cases 310*a*, 310*b* (collectively 310) positioned adjacent the ceiling 301. The corner display cases 310 are removably attached to a wall by support brackets 312. The display case 308 is removably attached to corner display case 310*b* and is removably attached to the ceiling 301 by a support bracket 314.

The elevator device 302 may include any number of components configured to raise and lower display cases 308 into a desired position. FIG. 6 shows an elevator track 316 coupled to a motor 318 to move the display cases 308 in vertical directions. The display cases 308 may have connection members on ends of each case that permits the elevator system to move and automatically couple display cases to each other. For example, the features described with reference to FIG. 5 permit such.

Figure 9:
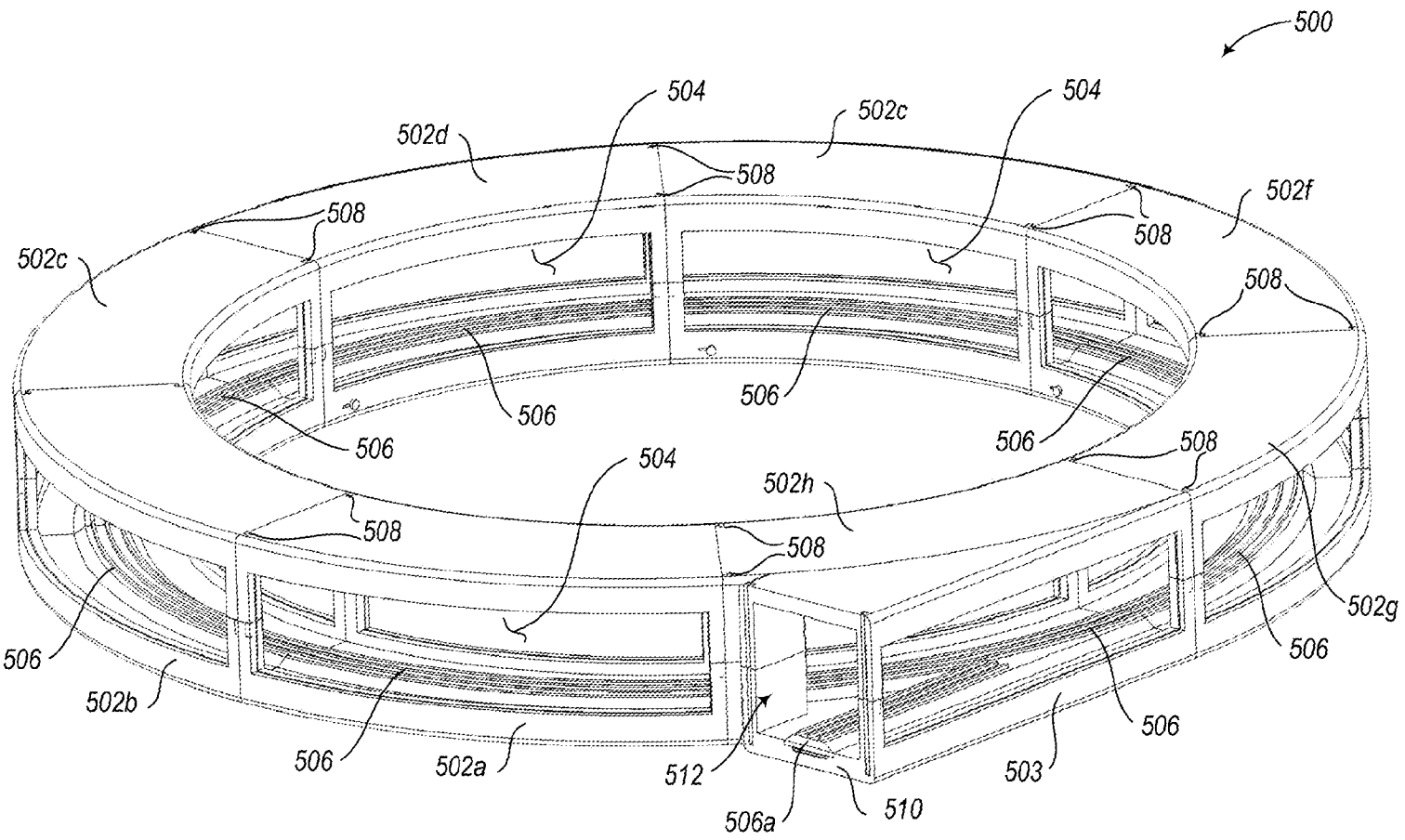
FIG. 9 is an isometric view of a display case system according to an embodiment.

A circular display system 320 is shown in the room 306 and includes a plurality of display cases 308. FIG. 9 shows further details.

Figure 7:
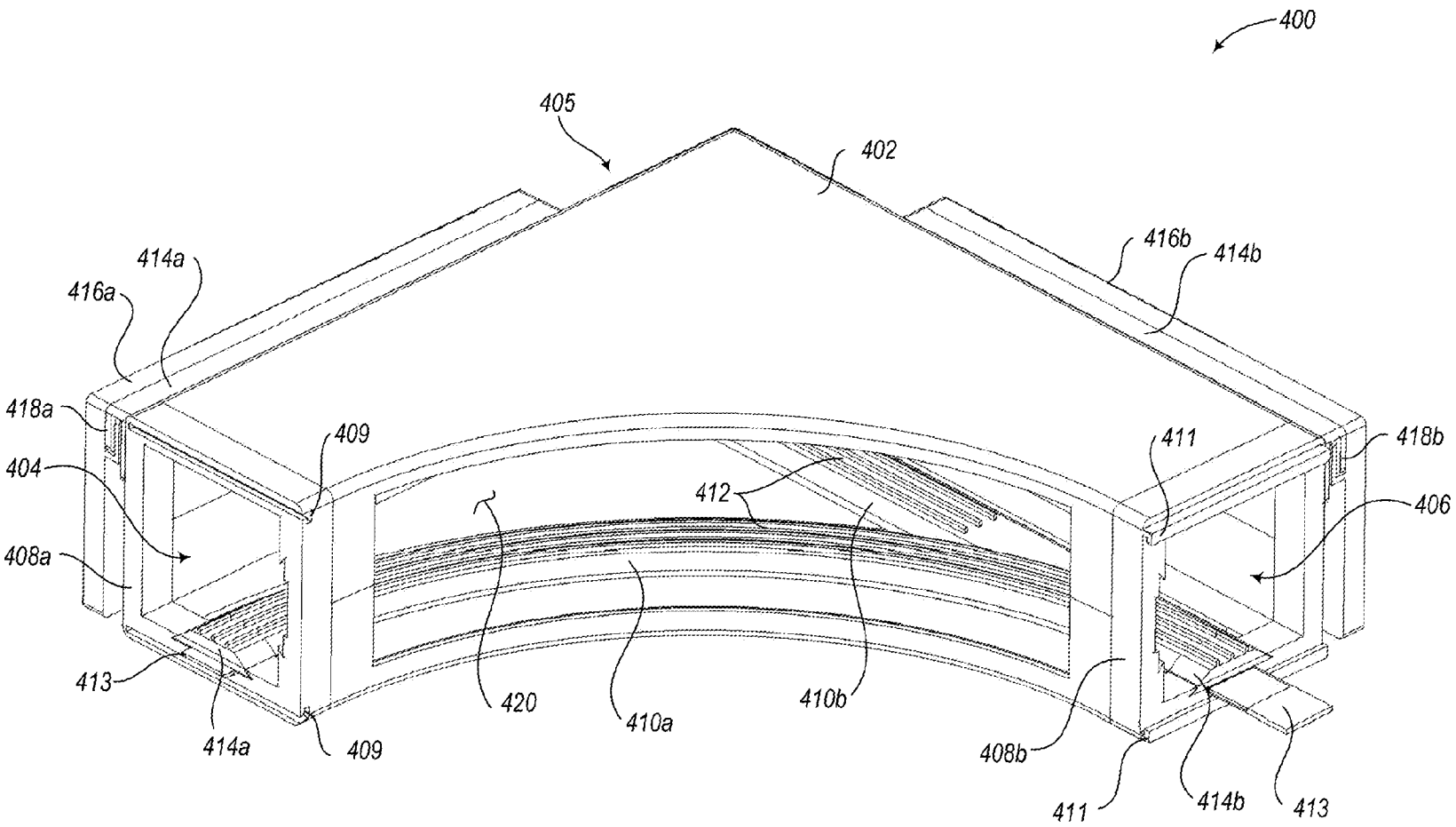
FIG. 7 is an isometric view of a corner display case according to an embodiment.
Figure 8:
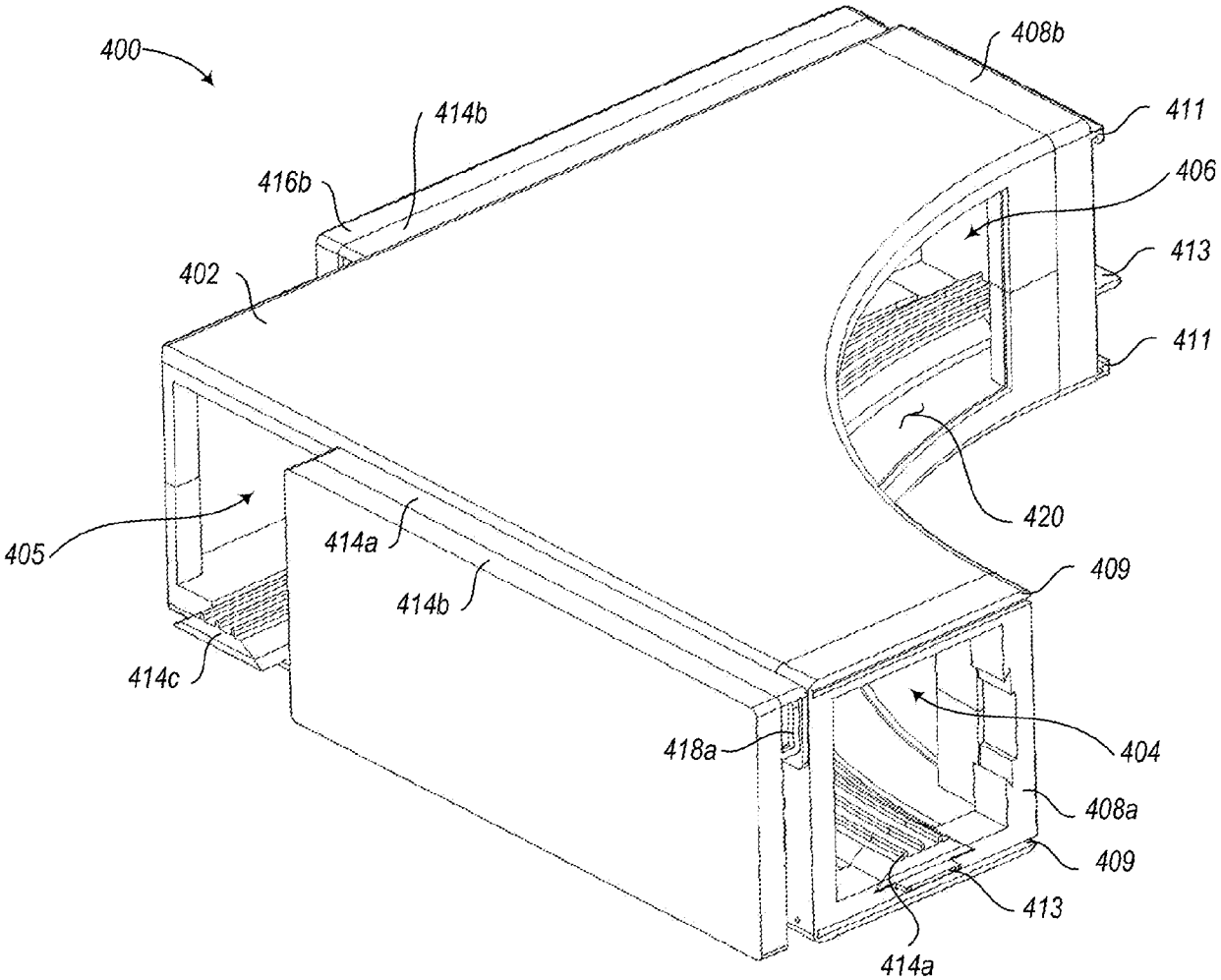
FIG. 8 is an isometric view of the corner display case of FIG. 7.

FIGS. 7 and 8 show a corner display case 400 having a body 402 defining a first opening 404, a second opening 405, and a third opening 406. The corner display case 400 may have the same or similar features of the display case 310*a* of FIG. 6. The openings 404, 405, 406 permit a model train to pass through the display case 400. The display case 400 includes end caps 408*a*, 408*b*, which each may have similar features to other end caps shown and discussed herein. End cap 408*a* includes female attachment members 409 and end cap 408*b* includes male attachment members 411 for attachment to adjoining cases. The display case 400 includes a track member 410*a* and a track member 410*b*, which each include tracks 412. Track connection portions 414*a*, 414*b*, 414*c* are positioned flush with exterior surfaces of the display case 400 for biasing to track connection portions of adjoining cases.

Electrical connection members 413 extend from respective end caps 408*a*, 408*b* and are operable to electrically connect tracks together, as previously discussed. The display case 400 includes support brackets 414*a*, 414*b* that each include a means to removably attach the display case 400 to support members 416*a*, 416*b*, which are secured to a wall. Thus, a user can vertically lift or lower the display case 400 over the support members 416*a*, 416*b* to quickly remove or attach the display case 400 to a wall. Advantageously, the members are hidden from view. A display panel 420 is attached to a front viewable portion of the display case 400.

FIG. 9 shows a display system 500 according to an embodiment. The system 400 includes a plurality of display cases 502 joined together to form a circular shaped display through with a model train may enter and circulate, for example. Each display case 502 may include some or all of the features discussed with reference to FIGS. 1-8 and 10. The plurality of display cases 502 include seven arced cases 502*a*-502*g* and one open arced case 502*h*. The display cases 502*a*-502*h* (collectively 502) each have at least one display panel 504 and a track 506. Each display panel 504 may be substantially transparent or may have a scenic image thereon. Each track 506 may be comprised of the track member and tracks discussed above. Each display cases 502*a*-502*h* are coupled to adjoining display cases with attachment devices 508, which may be the male and female attachment devices. The display case 502*h* includes a passageway portion 503 having an attachment end 510 that has an opening 512 through which a model train may enter to the display cases 500 and circle thereabout. The attachment end 510 is coupleable to any other suitable display case or system disclosed herein. The display system 500 may include another passageway portion and opening at a different position on the system so that a train may enter opening 512 and exit the other opening after circulating throughout the system.

Figure 10:
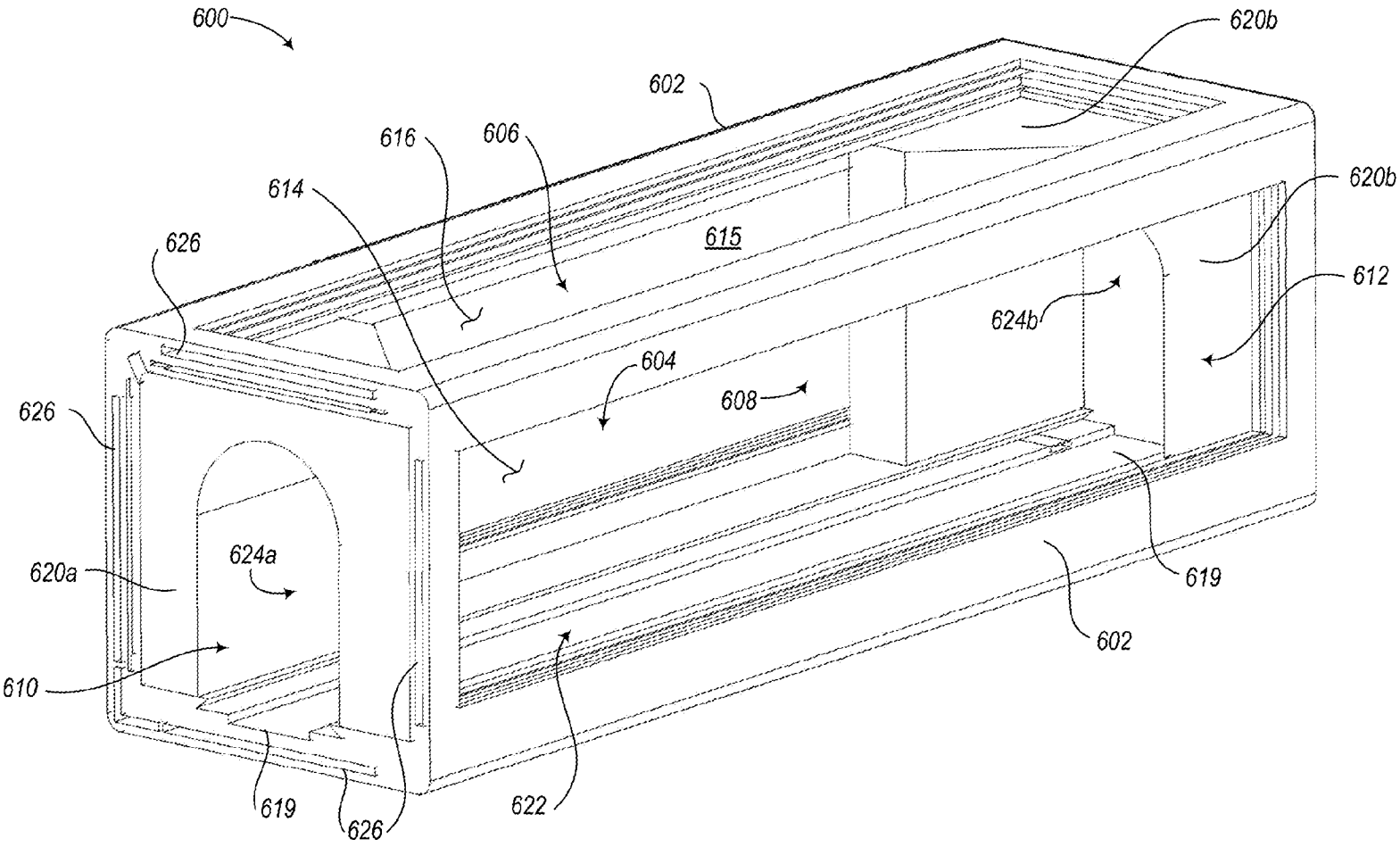
FIG. 10 is an isometric view of a display case according to an embodiment.

FIG. 10 shows a display case 600 according to an aspect of the present disclosure. The display case 600 includes an elongated body 602 having a front opening 604, a top opening 606, a rear opening 608, a left opening 610, and a right opening 512. The left and right openings are positioned at opposing ends of the case and allow egress and ingress of a display item (not shown), such as a model train car(s). A front display panel 614 is coupled to the case and covers the front opening. A top display panel 616 is coupled to the case and covers the top opening. A rear display panel 618 is coupled to the case and covers the rear opening, or it may cover the top, front, bottom, and side openings, or any combination thereof. All the display panels may be substantially transparent to allow viewing of a display item in the case. The rear display panel may have a scenic image attached thereto. The display case 600 includes a slot 619 configured to receive a track, such as described elsewhere in this disclosure. The display panels 614, 616, 618 may slide into place from ends of the display case, or they may hinge, snap, plug in to the front, back, bottom, or sides of the display case. The display panels 614, 616, 618 can be removed by sliding them from ends of the display case, by unsnapping them and removing them directly from their respective faces, by detaching them from hinges, or in any other suitable manner.

The display case 600 further includes a left tunnel member 620*a* and a right tunnel member 620*b* removably attached at opposing ends of the case 600. The tunnel members 620*a*, 620*b* may be removably attached to inner walls of the body 602 and within a cavity 622 defined by the body 602. The tunnel members 620*a*, 620*b* each have an opening 624*a*, 624*b*, respectively, through which a model train may pass, for example.

The display case 600 includes four male attachment devices 626 configured to receive female attachment devices on an adjoining display case, as further discussed in this disclosure.

In some embodiments, an adapter plate includes an opening and is positionable between adjoining display cases to allow mating between horizontal and vertical connections members of said display cases. This provides a system to adjoin a display case on a ceiling with a display case on a wall, for example, having connection members of different orientation. The adapter plate could be used on bridges, platforms, tunnels, or with the elevator system.

It will be appreciated that the display cases may be positioned at alternative positions and orientations, such as at an angle from horizontal, or completely vertical, for instance.

It will be appreciated that the display cases discussed herein could be used to display sports memorabilia, animated and non-animated characters, dolls, stamps, coins, and other collectibles.

In accordance with one aspect of the present disclosure, the display case is made from extruded plastic and has a back drop with a scenic image and having electronics, such as lights, in an upper corner of the display case to illuminate the display case. The back drop may be removable and replaced with a different back drop. The windows may slide into place from ends of the display case, or they may hinge, snap, plug in to the front, back, bottom, or sides of the display case.

In one aspect of the present disclosure, an accordion member is coupled between display cases. The accordion member may be used to position adjoining display cases at a different axis (or axes) relative to each other, and/or to allow adjustability of the space between display cases.

The display cases may be of varying lengths in order to customize a display system. A slider coupling can be positioned between adjoining display cases to allow for axial sliding movement of said display cases through an inner cavity of the slider coupling. As such, the display cases may have grooves to slide through the slider coupling.

In accordance with another aspect of the present disclosure, the display case includes a mounting system for mounting the display case to a structure, such as a wall. A wall mount can be fastened to a wall and can include a pair of mushroom snaps. A back plate can be fastened to a display case and can include a pair of openings to receive a portion of the mushroom snaps. The back plate can include a pair of quick release buttons operable to attach and remove the display case from the wall mount. Thus, a user can simply actuate the quick release buttons to disengage the display case from the wall mount. Accordingly, display cases are interchangeable to the wall mount.

In accordance with still yet another aspect of the present disclosure, an electrical connection system is coupleable to a display case below a track. The electrical connection system can have a slideable switch in a housing below the track. The slideable switch is operable to electrically couple tracks of adjoining display cases. The slideable switch is operable to receive either a male or female connection device of an adjoining display case so that adjoining display cases are flush against each other at respective ends of the cases. If a male connection is inserted into the switch, a female connection device is used and the slideable switch is at a first position. If a female connection is inserted into the switch, the slideable switch is moved inwardly of the housing and a male connection device shown on page 10 is used and the slideable switch is therefore in a second position. The slidability of the switch and the use of the connection members allows a male or female connection of an adjoining display case. The electrical connection system may be used when joining a track of a display case with a track not in a display case. The electrical connection system may be used between any tracks not in display cases.

The display case can be an enlarged display case having a bridge and a full display of an outdoor environment. The enlarged display case may include openings and attachment portions on opposing ends for attachment to a modular display cases and systems.

In accordance with yet a further aspect of the present disclosure, a circular display system may be coupled to a tree or tree stand. In one example, a display system includes a variety of features that are operable to move the display system between a collapsible state and an expandable state. For instance, hinges are provided that a configured so that as a base member is lifted vertically toward a center of the system, the track system folds downwardly and inwardly. In this fashion, the display system is reconfigurable to a collapsible state. Other examples of the circular display systems are provided as shown.

In another aspect of the present disclosure, a rail system has a track member attached to a ceiling with attachment devices and includes a support surface over which a model vehicle travels. The model vehicle includes wheels that correspond to the support surface so that the model vehicle may freely travel. The attachment devices are positioned adjacent the support surface so that the model vehicle freely travels along the track member. The model vehicle may include a motor, and it may be coupled to a motorized vehicle therebelow, such as a plane or other prop vehicle. The model vehicle includes a coupling portion to attach to adjoining model vehicles. The rail system is attachable to any number of mounting structures, such as wall, floors, curtains, overhead tracks, and the like.

Alternatively, a layered display system is provided that includes a plurality of images on transparent panels. The panels can overly each other to show a complete display image that may be inserted into a back panel of a display case and illuminated with lights, such as LEDs attached to the display case. A back drop image can be attached to a display case such that the image extends between and onto components, such as between the back drop and over the tunnel components.

Figure 11:
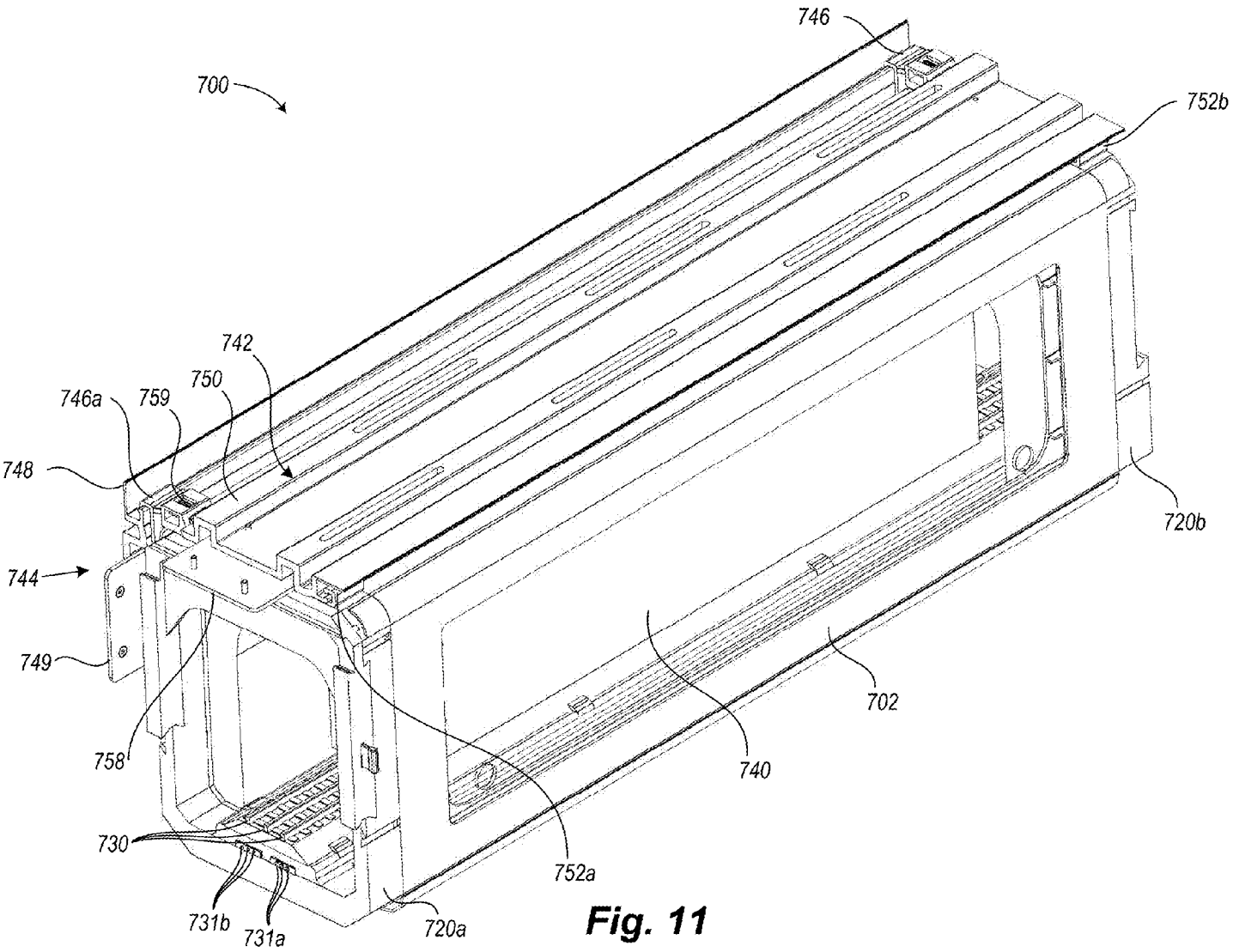
FIG. 11 is an isometric view of a display case according to one embodiment.

FIG. 11 is an isometric view of a display case 700 according to another aspect of the present disclosure. The display case 700 is similar to the display case 100 of FIG. 1 in many regards. The display case 700 includes a left end piece 720*a* and the right end piece 720*b*. The left end piece 720*a* includes electrical connectors 731*a* and 731*b*. A model train is shown on the tracks 730 of the display case 700. The display case 700 also includes a ceiling mount assembly 742 and a wall mount assembly 744. The ceiling mount assembly 742 is coupled to a top surface of the display case 700. The wall mount assembly 744 is coupled to a backside of the display case 700.

The ceiling mount assembly 742 includes a mounting bracket 750 coupled to a mounting plate 758. The ceiling mount assembly 742 further includes latches 752*a*, 752*b* that are fixed to the display case 700 and are configured to attach to the mounting bracket 750. The latch 752*a* includes a spring 754 that assists in attaching the latch 752*a* to the mounting bracket 750. The latch 752*b* is substantially identical to the latch 752*a*.

The wall mount assembly 744 includes a mounting bracket 748 coupled to the mounting plate 749. The wall mount assembly 744 further includes a latch member 746*a* coupled to a left end of the wall mount bracket 748 and a latch member 746*b* coupled to the right end of the wall mount bracket 748.

While FIG. 11 illustrates the display case 700 as including the wall mounting bracket 748 and the ceiling mount brackets 750, in practice the wall mounting bracket 748 and the mounting plate 749 are fixed to a wall on which the display case 700 can be placed for display or storage. Likewise, the ceiling mount bracket 750 and the mounting plate 758 are fixed to a ceiling from which the display case 700 can hang for storage or display. The wall latches 746*a*, 746*b* and the ceiling latches 752*a*, 752*b* are fixed to the display case 700. The display case 700 can be easily suspended from the wall or ceiling by coupling the wall latches 746*a*, 746*b* to the wall mounting bracket 748 or by coupling the latches 752*a*, 752*b* to the ceiling mounting bracket 750. In this way, the display case 700 can be easily and securely fastened to the wall mounting bracket 748 or the ceiling mounting bracket 750 for display or storage.

Figure 12:
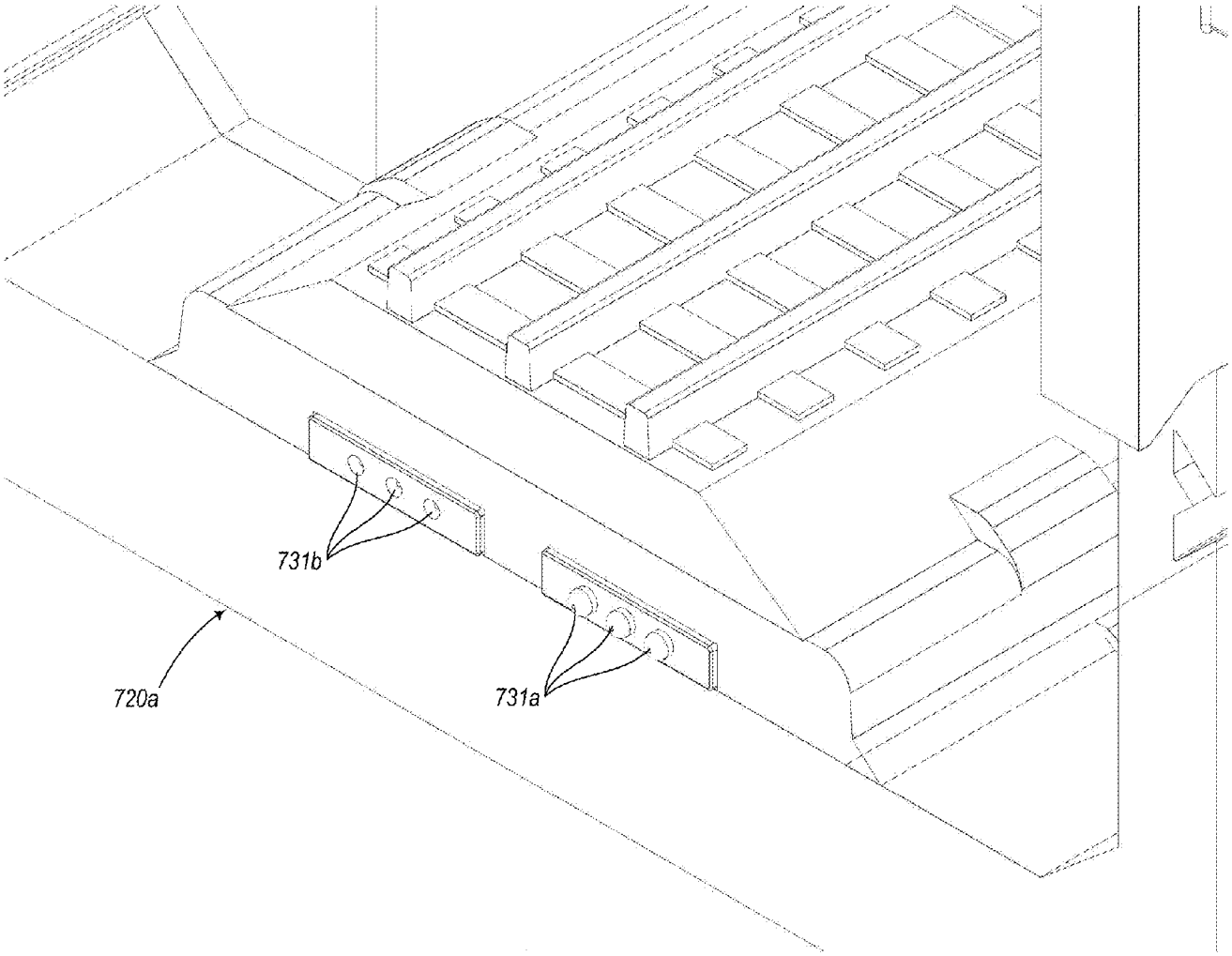
FIG. 12 is an enlarged isometric view of an end portion of a display case according to one embodiment.

FIG. 12 is an enlarged isometric view of the left end 720*a* of FIG. 11. The electrical connectors 731*a* are conductive protrusions that extend from the end cap 720*a*. The electrical connectors 731*b* are indentations in the end cap 720*a*. The electrical connectors 731*a*, 731*b* are configured to mate with compatible electrical connectors of another display case. In this way, electrical connection can be insured between display cases that are coupled together. The electrical connectors 731*a*, 731*b* are connected to electrical wires and other circuitry (not shown) within the display case 700 that enable movement of the train 740 or illumination of the display case 700 by lights (not shown).

Figure 13:
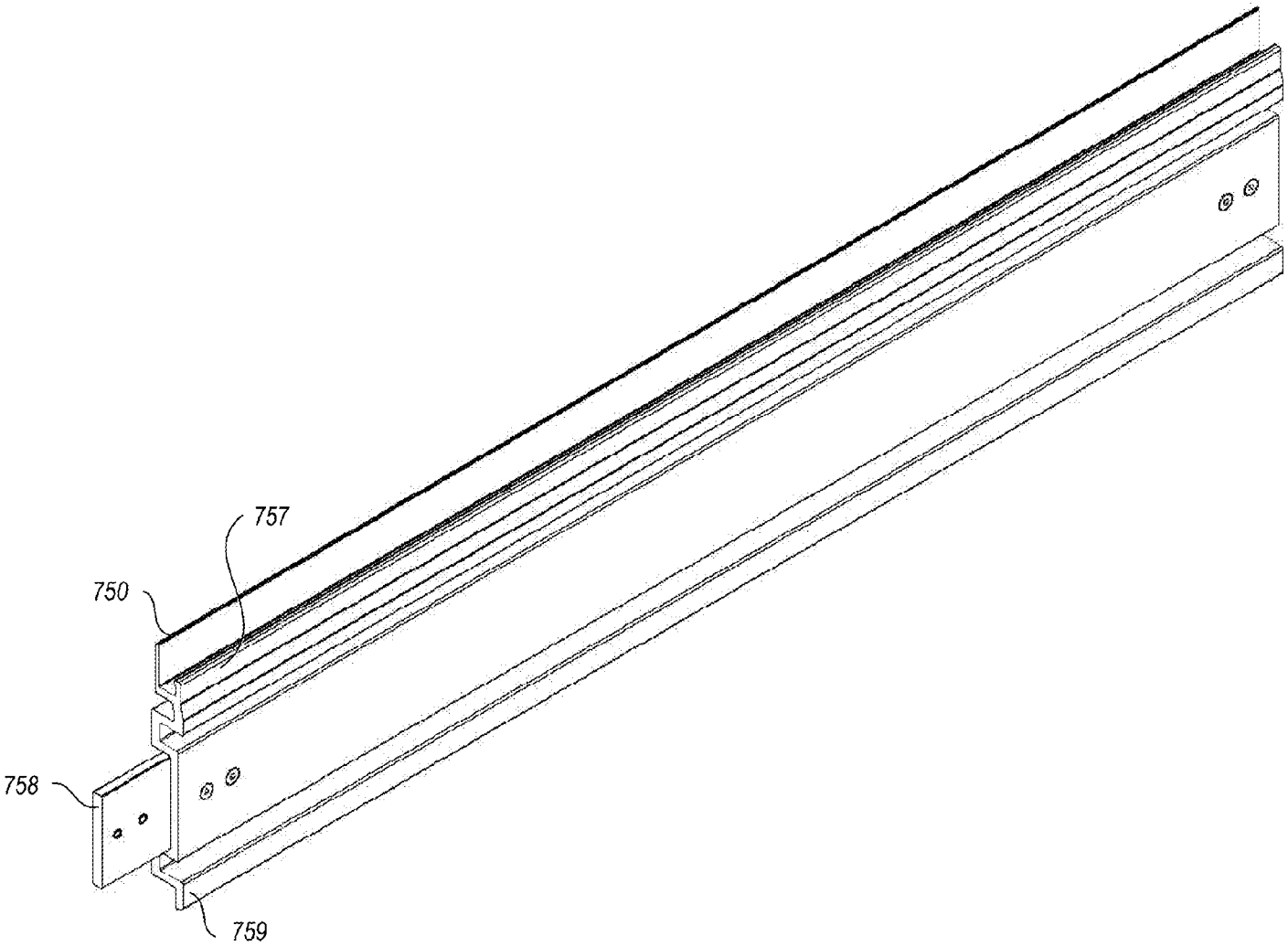
FIG. 13 is an isometric view of a ceiling mounting bracket and mounting plate according to one embodiment.

FIG. 13 is an isometric view of the ceiling mounting bracket 750 and ceiling mounting plate 758. The ceiling mounting bracket includes a first lip 757 and a second lip 759 for coupling to the mounting latch 752*a* as described in more detail below. Wall mounting plate 758 is configured to be fixed to a ceiling by screws or other suitable methods. The ceiling mounting bracket 750 is configured to be fixed to the mounting plate 758 and the ceiling by screws or other suitable methods. The wall mounting bracket 748 and mounting plate 749 are substantially similar to the ceiling mounting bracket 750 and wall mounting plate 758.

Figure 14:
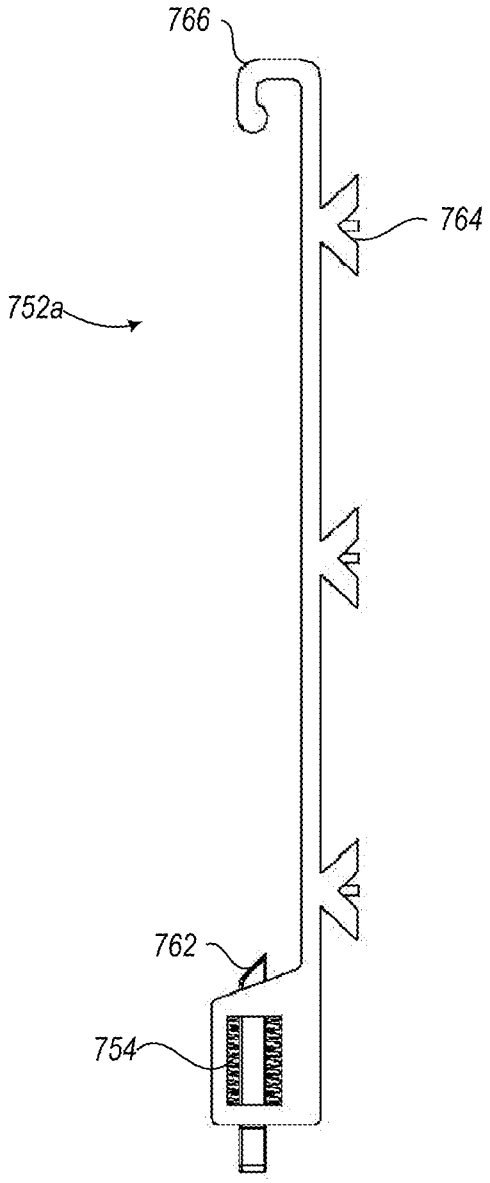
FIG. 14 is a side view of a ceiling mounting latch according to one embodiment.

FIG. 14 is a side view of the ceiling mounting latch 752*a*. The ceiling mounting latch 752*a* includes a spring 754 and a pin 762 coupled to the spring 754. The ceiling latch 752*a* further includes triangular protrusions 764 configured to mate with compatible indentations on top of the display case 700 not visible in FIG. 11. The ceiling mounting latch also includes a hook portion 766.

To attach the ceiling mounting latch 752*a* to the ceiling mounting bracket 750, the hook portion 766 is hooked over a compatible lip 757 of the ceiling mounting bracket 750. The opposite end of the ceiling mounting latch is then brought upward and the pin 762 is pressed against the lip portion 759 of the mounting bracket 750. Do to the slanted tip of the pint 762, the pin 762 slides toward the spring allowing the lip 759 to pass below the pin, at which point the pin is resiliently forced back to a rest position by the spring 754. The ceiling mounting latch 752*a* is then securely fixed to and suspended from the ceiling mounting bracket 750. In this way the display case, which is fixed to the ceiling latch 752*a*, can be suspended from the ceiling for storage or display purposes. The ceiling mounting latch 752*a* can be detached from the mounting bracket 750 by manually pressing in the pin 762 to release the ceiling mounting latch from the lip 759. Though not show, the ceiling mounting latch 752*b* is substantially identical to the ceiling mounting latch 752*a* and would be attached at the same time and in the same manner as the ceiling mounting latch 752*a* in order to suspend the display case 700 from the ceiling mounting bracket 750.

Similar to the ceiling mounting latch 752*a*, the wall mounting latches 746*a*, 746*b* each include a hook portion substantially similar to the hook portion 766 of the ceiling mounting latch 752*a*. The hook portions of the mounting latches 746*a*, 746*b* can be hooked over a compatible lip of the wall mounting bracket 748 in order to attach the display case 700 to the wall mounting bracket 748 for display or storage.

Figure 15:
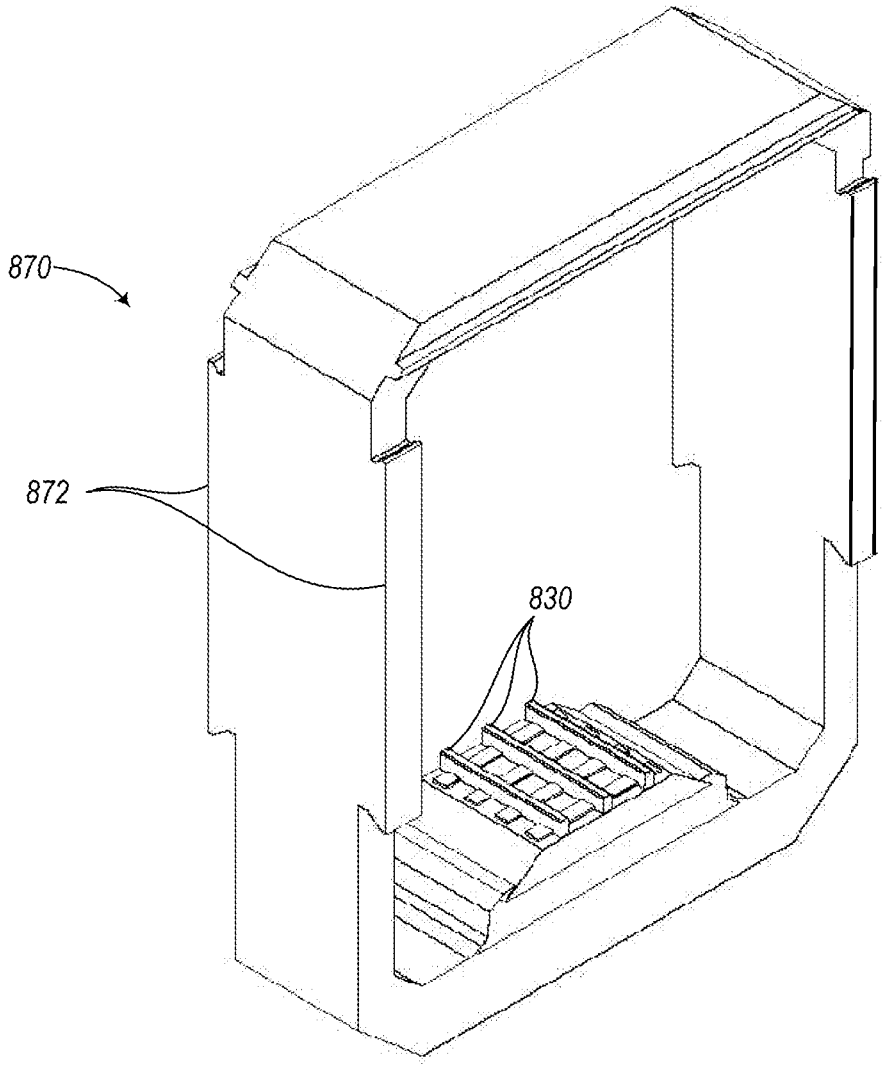
FIG. 15 is an isometric view of a display case joiner assembly according to one embodiment.

FIG. 15 is an isometric view of a display case joiner assembly 870 according an aspect of the present disclosure. The display case joiner assembly 870 includes tracks 830 and four attachment protrusions 872.

The display case joiner assembly 870 is configured to connect two display cases together. The display cases can be similar to those described previously except that they each include indentations on the end caps that will accommodate the attachment protrusions 872 of the joiner assembly 870. Thus, when two display cases are to be coupled together, two of the attachment protrusions 872 are coupled to the compatible indentations on a first display case. The other two attachment protrusions 872 are then coupled to the compatible indentations on the second display case. When the display case joiner assembly is connected to two display cases, the tracks 830 of the display case joiner assembly 870 align with the tracks of the display cases forming continuous tracks between the first and second display cases.

Though not illustrated in FIG. 15, the joiner assembly 870 can also include electrical connectors compatible with the electrical connectors of the display cases. The electrical connectors of the joiner assembly 870 can therefore be compatible with the electrical connectors 131, 731*a*, 731*b* or with any other type of electrical connectors that may be used with the display cases.

Those of skill in the art will recognize, in light of the present disclosure, that the joiner assembly 870 can made in many other configurations such as having indentations instead of protrusions 872, a combination of indentations and protrusions, latches, or any other suitable configurations for coupling two display cases together. All such other configurations fall within the scope of the present disclosure.

It will be appreciated that the various aspects of the present disclosure could be used with any scale of model railroad system.

The display cases and other aspects of the present disclosure can be made from any suitable materials such extruded plastic, other types of plastic, suitable metals or metal alloys, suitable wood such as cherry, oak, etc. Those of skill in the art will recognize in light of the present disclosure that many other materials can be used for the components described in the present disclosure. All such other materials fall within the scope of the present disclosure.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display case for a display item, comprising:

a body having a first end and a second end;

a cavity extending through the body from the first end to the second end, the cavity configured to receive the display item therein;

a first end cap attached to the first end, the first end cap having an attachment device removably attachable to an attachment device of an adjoining display case;

a second end cap attached to the second end, the second end cap having an attachment device removably attachable to an attachment device of an adjoining display case, each attachment device of the first and second end caps configured to provide electrical continuity between metal tracks in each of the display cases; and a switch system for electrically attaching the metal tracks to adjoining metal tracks, the switch system having a slidable switch operable to a first position and a second position, the first position for connecting a male member of the adjoining metal tracks and the second position for connecting a female member of different adjoining metal tracks, the slidable switch disposed below the metal tracks such that adjoining metal tracks and different adjoining metal tracks are electrically attached to the metal tracks in the display case via the slidable switch.

2. The display case of claim 1 comprising at least one display panel attached to the body, the at least one display panel substantially transparent.

3. The display case of claim 1 comprising a base panel attached to the body and having a track member made of metal with a first end adjacent the first end of the display case, the track member configured to guide the at least one display item into the cavity of the display case and configured to directly couple to an adjoining track member of an adjoining display case.

4. The display case of claim 3 wherein the track member comprises electrically conductive material and is configured to be electrically coupled to the adjoining track member of the adjoining display case via the attachment device.

5. The display case of claim 1, comprising a release mechanism attached to the body, the release mechanism having at least one mechanism configured to removably attach the display case to a structure, the at least one mechanism having a quick-release device to remove and attach the display case to the structure.

6. The display case of claim 1, comprising a tunnel component coupled to the body, the tunnel component having an aperture configured to allow passage of a display item therethrough.

7. A display system, comprising:

at least two of the display cases, each display case comprising:

a body having a first end and a second end;

a cavity extending through the body from the first end to the second end, the cavity configured to receive at least one display item therein;

a first end cap attached to the first end, the first end cap having an attachment device removably attachable to an attachment device of an adjoining display case; and a second end cap attached to the second end, the second end cap having an attachment device removably attachable to an attachment device of an adjoining display case, each attachment device of the first and second end caps configured to provide electrical continuity between metal tracks in each of the display cases;

wherein one of the at least two display cases has a length different than a length of the other one of the at least two display cases, and wherein the at least two display cases are removably attached to each other such that the metal tracks of each of the at least two display cases are directly coupled to each other.

8. A display system, comprising:

a plurality of display cases, each display case having an elongated body and a cavity extending through the elongated body, metal tracks extending through the cavity, and at least one attachment device on an end of the elongated body configured to attach to an adjoining display case;

one of the plurality of display cases having a first length and one of the plurality of display cases having a second length different than the first length; and a switch system for electrically attaching the metal tracks to adjoining metal tracks, the switch system having a slidable switch operable to a first position and a second position, the first position for connecting a male member of the adjoining metal tracks and the second position for connecting a female member of different adjoining metal tracks, the slidable switch disposed below the metal tracks such that adjoining metal tracks and different adjoining metal tracks are electrically attached to the metal tracks in the display case via the slidable switch.

9. The display system of claim 8 wherein each display case includes a first end and a second end at opposing ends of the elongated body, and a first attachment member coupled to the first end of the body and configured to couple the display case with an attachment member of an adjoining display case of the plurality of display cases.

10. The display system of claim 9 wherein each display case includes a second attachment member coupled to the second end of the elongated body and configured to couple the display case with an attachment member of an adjoining display case of the plurality of display.

11. The display system of claim 8 comprising an elevator system having at least one elevator device configured to move the display cases of the plurality of display cases.

* * * * *